US007354892B2

(12) United States Patent
Bastigkeit et al.

(10) Patent No.: US 7,354,892 B2
(45) Date of Patent: Apr. 8, 2008

(54) LOW SUDS LAUNDRY DETERGENTS WITH ENHANCED WHITENESS RETENTION

(75) Inventors: Thorsten Bastigkeit, Scottsdale, AZ (US); Jessica Lawshe, Chandler, AZ (US); Daniel Wood, Phoenix, AZ (US); Aurora Stamper, Phoenix, AZ (US); Joan Bergstrom, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 82 days.

(21) Appl. No.: 11/517,230

(22) Filed: Sep. 7, 2006

(65) Prior Publication Data

US 2008/0064618 A1 Mar. 13, 2008

(51) Int. Cl.

| | |
|---|---|
| ***C11D 1/831*** | (2006.01) |
| ***C11D 1/04*** | (2006.01) |
| ***C11D 7/14*** | (2006.01) |
| ***C11D 3/37*** | (2006.01) |

(52) U.S. Cl. ..... 510/425; 510/276; 510/289; 510/290; 510/303; 510/351; 510/352; 510/337; 510/353; 510/356; 510/357; 510/361; 510/389; 510/398; 510/399; 510/421; 510/422; 510/426; 510/427; 510/428; 510/430; 510/434; 510/511; 510/481; 510/491; 510/533

(58) Field of Classification Search ..... 510/276, 510/289, 290, 303, 351, 352, 337, 353, 356, 510/357, 361, 389, 398, 399, 421, 422, 425, 510/426, 427, 428, 430, 434, 511, 481, 491, 510/533

See application file for complete search history.

(56) References Cited

U.S. PATENT DOCUMENTS

| | | | | |
|---|---|---|---|---|
| 2,954,347 | A | 9/1960 | St. John et al. | |
| 2,954,348 | A | 9/1960 | Schwoeppe et al. | |
| 3,707,503 | A | 12/1972 | Kenny et al. | |
| 3,892,680 | A | 7/1975 | Benjamin et al. | |
| 3,929,663 | A | 12/1975 | Arai et al. | |
| 4,009,114 | A | 2/1977 | Yurko | |
| 4,304,680 | A | 12/1981 | Wixon | |
| 5,425,891 | A | 6/1995 | Pujol et al. | |
| 5,565,422 | A * | 10/1996 | Del Greco et al. | 510/443 |
| 5,730,760 | A * | 3/1998 | Kirk et al. | 8/137 |
| 5,814,242 | A * | 9/1998 | Alvarez et al. | 252/186.39 |
| 5,919,747 | A * | 7/1999 | Kazuta et al. | 510/444 |
| 6,169,063 | B1 * | 1/2001 | Kvietok et al. | 510/317 |
| 6,242,406 | B1 * | 6/2001 | Katsuda et al. | 510/357 |
| 6,288,016 | B1 * | 9/2001 | Ramanan et al. | 510/357 |
| 2006/0035795 | A1 * | 2/2006 | Warr et al. | 510/101 |
| 2006/0089284 | A1 * | 4/2006 | Miracle et al. | 510/320 |
| 2006/0189501 | A1 * | 8/2006 | Lant et al. | 510/392 |
| 2007/0173430 | A1 * | 7/2007 | Souter et al. | 510/320 |

* cited by examiner

*Primary Examiner*—Charles Boyer
(74) *Attorney, Agent, or Firm*—Paul A. Pappalardo

(57) ABSTRACT

A unique laundry detergent composition is described that comprises linear alkyl benzene sulfonate, alkyl ether sulfate, alcohol ethoxylate, fatty acid, an alkali metal silicate, polyacrylate, and optionally carbonate, that is low sudsing and that shows improved whiteness retention over other fatty acid soap containing detergents in the absence of silicates.

9 Claims, No Drawings

LOW SUDS LAUNDRY DETERGENTS WITH ENHANCED WHITENESS RETENTION

FIELD OF INVENTION

The present invention relates to high-efficiency low-sudsing liquid laundry detergent compositions. More particularly, this invention relates to a detergent composition utilizing silicate with fatty acid soaps and synthetic surfactants to create compositions that are low sudsing yet show enhanced whiteness retention.

BACKGROUND OF THE INVENTION

Liquid laundry detergents have been known in the art for many decades. Modern detergents are non-phosphated and are preferably comprised of synthetic anionic surfactants in order to mitigate the effects of hard water on both the cleaning performance and the machine. However, highly anionic detergent compositions foam considerably in modern washing machines, even to the extent where cleaning efficiency is reduced due to the foam cushioning the agitation of the fabrics. Formulation strategies to reduce the sudsing of synthetic anionic laundry detergents are well known in the prior art, although much of the art relates to powdered detergents and not liquid compositions and to older phosphated and/or heavily built formulations.

For example, U.S. Pat. No. 2,954,347 (St. John et al.) discloses the addition of fatty acid mixtures to powdered anionic surfactant compositions to reduce sudsing. The '347 patent specifically states that there is no measurable decrease in cleaning efficiency from the addition of certain fatty acid mixtures to detergents comprising synthetic anionic sulfate or sulfonate surfactants. Clearly the reduction in sudsing without concomitant reduction in performance was possible in the examples within '347 because of the high levels of phosphate utilized, (a strategy possible in powdered detergents, and commonplace before environmental concerns and regulatory constraints).

U.S. Pat. No. 2,954,348 (Schwoeppe) describes adding a synergistic combination of fatty acids and nonionic surfactants to synthetic anionic detergents in order to reduce foaming and maintain performance. The compositions described in '348 are also powders and phosphated, wherein the phosphate content may help to mitigate the deleterious effects of the added fatty acids. The nonionic surfactants described in the '348 patent were the Pluronic® surfactants, many of which were not only non-foaming but also defoaming.

U.S. Pat. No. 3,707,503 (Kenny) describes the use of certain alkanolamides with a select group of saturated fatty acids for controlling the sudsing of anionic detergent compositions. These compositions are also powders and contain phosphate (for example tetrapotassium pyrophosphate) or NTA as strong chelants to counteract the hard water effects of the added fatty acids.

U.S. Pat. No. 3,892,680 (Benjamin, et al.) describes maintaining cleaning performance and/or whiteness in a non-phosphated powder composition by the combination of calcium-insensitive synthetic anionic surfactants, such as alkyl ether sulfate, alkali metal carbonate and alkali metal silicate. The formulations disclosed in '680 do not include fatty acids and the disclosure is silent on the suds levels of these compositions that are devoid of fatty acid soaps.

U.S. Pat. No. 3,929,663 (Arai, et al.) describes "controlled foaming detergent compositions" by the addition of alkyloxy- or alkyloxymethyl-fatty acids to linear alkylbenzene sulfonate detergents, however again in powdered compositions further comprising phosphate. Most interesting is the mention that "no notable foam-controlling effect, like the one obtained with ABS [referring to branched alkyl benzene sulfonate] can be obtained by adding thereto sodium stearate" ('663, Col 1, Lines 35-38). The inventors are apparently stating that ordinary straight chain fatty acids soaps are useful for controlling the sudsing in branched alkyl benzene sulfonate (ABS) containing detergents, but are not useful for controlling the suds in linear alkyl benzene sulfonate detergents. As will be described below, we believe the fatty acid soaps do modulate sudsing of linear alkyl benzene containing liquid compositions, but that the real problem to overcome is the increase in graying of fabrics.

U.S. Pat. No. 4,009,114 (Yurko) relates to non-phosphated powdered laundry detergent compositions comprising the combination of alkyl aryl sulfonate anionic surfactant (including linear alkyl benzene sulfonate), fatty acid soap, citric acid, along with carbonate and silicate in a ratio of from 4:1 to 1:4, but does not suggest the enhanced whiteness retention properties of the unique combination of surfactants involved in the present invention.

U.S. Pat. No. 4,304,680 (Wixon) discloses improvement in the performance of "laundry soap" by addition of alcohol ether sulfate along with alkali metal carbonate, alkali metal silicate, or mixtures thereof. The '680 product is predominately a fatty acid soap, with "soap curd" reducing additives that include organic solvents and minor quantities of synthetic surfactant combinations differing from the combinations used in the present invention.

U.S. Pat. No. 5,425,891 (Pujol et al.) describes the use of a combination of fatty acid soaps and ethoxylated glycerin to reduce the sudsing seen from powdered anionic detergents comprising sodium dodecylbenzene sulfonate, while maintaining or even improving cleaning performance. The examples disclosed in '891 are highly chelated with either tripolyphosphate or zeolite and also comprise enzymes. For these examples, we surmise it would be difficult to see the deleterious effects of the added fatty acid soaps or known for certain if the ethoxylated glycerin assisted performance.

With modern high-efficiency liquid detergents that are non-phosphated through environmental regulation, and necessarily not heavily built due to solubility, safety and viscosity constraints, it is well known that the addition of fatty acids to anionic detergent compositions increases the graying of fabrics. That is, there is much reduced whiteness retention when laundering white/light fabrics with detergents containing fatty acid soaps. Accordingly, liquid laundry detergent compositions that show improved whiteness retention and controlled sudsing incorporating common synthetic anionic surfactant and fatty acid soaps are heretofore unknown. There is a clear need for improved liquid laundry detergent compositions that are based on common inexpensive ingredients.

It has now been surprisingly found that the combination of fatty acids, alkyl benzene sulfonate, alcohol ether sulfate, alcohol ethoxylate, polyacrylate and most importantly silicate, provide for a low sudsing, high efficiency liquid laundry detergent with unprecedented whiteness retention. Unexpectedly, silicate has been found to mitigate the graying of fabrics commonly seen when using fatty acids soaps in anionic detergent compositions.

SUMMARY OF THE INVENTION

Our summary of the invention is intended to introduce the reader to general aspects of the detergent compositions and not intended to be a complete description. Particular aspects of the present invention are described in other sections below.

In accordance with an exemplary embodiment of the present invention, a liquid laundry detergent composition is provided that is low sudsing and that shows marked improvement in whiteness retention. The liquid laundry detergent compositions of the present invention include anionic sulfonate and sulfate surfactant components, a nonionic surfactant component, fatty acid soaps, polyacrylate polymer, and silicate. In accordance with another exemplary embodiment, a liquid laundry detergent composition is provided with these components along with carbonate builder. Performance data clearly demonstrates that the addition of silicate markedly improves whiteness retention.

DETAILED DESCRIPTION OF THE INVENTION

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and relative amounts of components described without departing from the scope of the invention as set forth in the appended claims.

The present invention relates to a composition for laundering fabrics that exhibits low sudsing and enhanced whiteness retention. The liquid laundry detergent compositions of the present invention include anionic surfactant components, preferably sulfonate and sulfate compounds, together totally from about 1.5-14%, nonionic surfactant from about 0.5% to about 5%, fatty acid soaps from about 0.05-2%, polyacrylate polymer from about 0.1-1%, and silicate from about 0.5-5%. In accordance with another exemplary embodiment, a liquid laundry detergent composition is provided with these components along with carbonate builder present at up to about 4%.

Anionic surfactants that are useful in the compositions of the present invention are the alkyl benzene sulfonates. Suitable alkyl benzene sulfonates include the sodium, potassium, ammonium, lower alkyl ammonium and lower alkanol ammonium salts of straight or branched-chain alkyl benzene sulfonic acids. Alkyl benzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids, functioning as precursors to the alkyl benzene sulfonates useful for compositions herein, are those in which the alkyl chain is linear and averages about 8 to 16 carbon atoms ($C_8$-$C_{16}$) in length. Examples of commercially available alkyl benzene sulfonic acids useful in the present invention include Calsoft® LAS-99, Calsoft® LPS-99 or Calsoft® TSA-99 marketed by the Pilot Chemical Company. Most preferred for use in the present invention is sodium dodecylbenzene sulfonate, most easily available by the in-situ neutralization of the above mentioned sulfonic acids with caustic (NaOH) in the compositions of the present invention, or available as the sodium salt of the sulfonic acid, for example Calsoft® F-90, Calsoft® P-85, Calsoft® L-60, Calsoft® L-50, or Calsoft® L40. Also of use in the present invention are the ammonium salts, lower alkyl ammonium salts and the lower alkanol ammonium salts of linear alkyl benzene sulfonic acid, such as triethanol ammonium linear alkyl benzene sulfonate including Calsoft® T-60 marketed by the Pilot Chemical Company. The preferred level of sulfonate surfactant in the present invention is from about 0.5% to about 4%. Most preferred is to use dodecylbenzene sulfonic acid (LAS) at a level of from about 1% to about 3% (which will react in-situ to sodium dodecyl benzene sulfonate in the final composition).

Also with respect to the anionic surfactants useful in this composition, the alkyl ether sulfates, also known as alcohol ether sulfates, are preferred. Alcohol ether sulfates are the sulfuric monoesters of the straight chain or branched alcohol ethoxylates and have the general formula $R—(CH_2CH_2O)_x—SO_3M$, where $R—(CH_2CH_2O)_x—$ preferably comprises $C_7$-$C_2$, alcohol ethoxylated with from about 0.5 to about 9 mol of ethylene oxide (x=0.5 to 9 EO), such as $C_{12}$-$C_{18}$ alcohols containing from 0.5 to 9 EO, and where M is alkali metal or ammonium, alkyl ammonium or alkanol ammonium counterion. Preferred alkyl ether sulfates for use in one embodiment of the present invention are $C_8$-$C_{18}$ alcohol ether sulfates with a degree of ethoxylation of from about 0.5 to about 9 ethylene oxide moieties and most preferred are the $C_{12}$-$C_{18}$ alcohol ether sulfates with ethoxylation from about 1.5 to about 9 ethylene oxide moieties, with 7 ethylene oxide moieties being most preferred. It is understood that when referring to alkyl ether sulfates, these substances are already salts (hence "sulfonate"), and most preferred and most readily available are the sodium alkyl ether sulfates (also referred to as NaAES). Commercially available alkyl ether sulfates include the CALFOAM® alcohol ether sulfates from Pilot Chemical, the EMAL®, LEVENOL® and LATEMAL® products from Kao Corporation, and the POLYSTEP® products from Stepan, however most of these have fairly low EO content (e.g., average 3 or 4-EO). Alternatively the alkyl ether sulfates for use in the present invention may be prepared by sulfonation of alcohol ethoxylates (i.e., nonionic surfactants) if the commercial alkyl ether sulfate with the desired chain lengths and EO content are not easily found, but perhaps where the nonionic alcohol ethoxylate starting material may be. For example, sodium lauryl ether sulfate ("sodium laureth sulfate", having about 3 ethylene oxide moieties) is very readily available commercially and quite common in shampoos and detergents, however, this is not the preferred level of ethoxylation for use in the present invention. For example it may be more practical to sulfonate a commercially available nonionic surfactant such as Neodol® 25-7 Primary Alcohol Ethoxylate (a $C_{12}$-$C_{15}$/7EO nonionic from Shell) to obtain the $C_{12}$-$C_{15}$/7EO alkyl ether sulfate that may have been more difficult to source commercially. The preferred level of $C_{12}$-$C_{18}$ alkyl ether sulfate with 1.5 to about 9 ethylene oxide moieties in the present invention is from about 1% to about 10%. Most preferred is a level of from about 3% to about 8%.

Most preferred for use in the compositions of the present invention is a mixture of both types of anionic surfactants described above. That is, it is preferable to incorporate both the linear alkyl benzene sulfonate and alcohol ether sulfate surfactants in the same compositions. Most preferable is to incorporate sodium dodecyl benzene sulfonate and a $C_{12}$-$C_{18}$ sodium alkyl ether sulfate with 0.5 to 9 ethylene oxide moieties together in the compositions of the present invention, and to incorporate a total sulfonate and alkyl ether sulfate level of from about 1.5% to about 14%, most preferably from about 2% to about 12%.

The compositions of the present invention preferably include nonionic surfactant. Nonionic surfactants are particularly good at removing oily soils from fabrics. Nonionic surfactants useful in the present invention include ethoxylated and/or propoxylated, primary alcohols having 10 to 18 carbon atoms and on average from 4 to 10 mol of ethylene oxide (EO) and/or from 1 to 10 mol of propylene oxide (PO) per mole of alcohol. Further examples are alcohol ethoxylates containing linear radicals from alcohols of natural origin having 12 to 18 carbon atoms, e.g., from coconut, palm, tallow fatty or oleyl alcohol and on average from 4 to about 9 EO per mole of alcohol. In formulating the liquid detergent composition of the present invention, nonionic surfactants of the alcohol ethoxylate type are useful since a proper HLB balance can be achieved between the hydrophobic and hydrophilic portions of the surfactant. Most useful as a nonionic surfactant in the present invention is the $C_{14}$-$C_{15}$ alcohol ethoxylate-7EO, mentioned above as a useful precursor to the corresponding sulfate, and at a preferred level of from about 0.5% to about 5%.

The fatty acids that find use in the present invention may be represented by the general formula R—COOH, wherein R represents a linear or branched alkyl or alkenyl group having between about 8 and 24 carbons. It is understood that within the compositions of the present invention, the free fatty acid form (the carboxylic acid) will be converted to the alkali metal salt in-situ (that is, to the fatty acid soap, or the more formally the "carboxylate salt"), by the excess alkalinity present in the composition. As used herein, "soap" means salts of fatty acids. Thus, after mixing and obtaining the compositions of the present invention, the fatty acids will be present in the composition as R—COOM, wherein represents a linear or branched alkyl or alkenyl group having between about 8 and 24 carbons and M represents an alkali metal such as sodium or potassium. The fatty acid soap, which is a desirable component having suds reducing effect in the washer, (and especially advantageous for side loading or horizontal tub laundry machines), is preferably comprised of higher fatty acid soaps. That fatty acids that are added directly into the compositions of the present invention may be derived from natural fats and oils, such as those from animal fats and greases and/or from vegetable and seed oils, for example, tallow, hydrogenated tallow, whale oil, fish oil, grease, lard, coconut oil, palm oil, palm kernel oil, olive oil, peanut oil, corn oil, sesame oil, rice bran oil, cottonseed oil, babassu oil, soybean oil, castor oil, and mixtures thereof. Fatty acids can be synthetically prepared, for example, by the oxidation of petroleum, or by hydrogenation of carbon monoxide by the Fischer-Tropsch process. The fatty acids of particular use in the present invention are linear or branched and containing from about 8 to about 24 carbon atoms, preferably from about 10 to about 20 carbon atoms and most preferably from about 14 to about 18 carbon atoms. Preferred fatty acids for use in the present invention are tallow or hydrogenated tallow fatty acids. Preferred salts of the fatty acids are alkali metal salts, such as sodium and potassium or mixtures thereof and, as mentioned above, preferably the soaps generated in-situ by neutralization of the fatty acids with excess alkali from the silicate. Other useful soaps are ammonium and alkanol ammonium salts of fatty acids, with the understanding that these soaps would necessarily be added to the compositions as the preformed ammonium or alkanol ammonium salts and not neutralized in-situ within the compositions of the present invention, (in the instant invention, in-situ neutralization of the fatty acids will necessarily generate sodium or potassium salts, or mixtures thereof of the fatty acids, due to the presence of the silicate having excess alkali). The fatty acids that may be included in the present compositions will preferably be chosen to have desirable detergency and effective suds reducing effect. Of course, for compositions wherein foaming is desirable soap content is omitted or lowered or a lower fatty acid soap, e.g., sodium laurate, may be used instead, but this is not the preferred strategy for the compositions of the present invention where suds suppression is desired. Most preferably in the present invention is to add tallow fatty acid, such as EMERY® 536 FATTY ACID from Cognis, (which comprises a complicated distribution of $C_{14}$-$C_{18}$ saturated and unsaturated fatty acids) at a level of from about 0.05% to about 2% and allow the fatty acids to neutralize in-situ to the soap in the alkaline composition.

The compositions of the present invention contain one or more silicate substances to reverse the deleterious fabric-graying effects of the added fatty acids in the compositions. The preferred silicate is an alkali metal silicate salt (the alkali metal salts of silicic acid) with the sodium and potassium silicate salts being the most preferred. The alkali metal silicates that are useful may be in a variety of forms that can be described by the general formula $M_2O:SiO_2$, wherein M represents the alkali metal and in which the ratio of the two oxides varies. Most useful alkali metal silicates will have a $SiO_2/M_2O$ weight ratio of from about 1.6 to about 4. These silicates provide alkalinity to the composition (and to the resulting laundry wash liquor) and this alkalinity is far in excess of what is required to neutralize the small amounts of added fatty acids in the compositions to their corresponding alkali metal salts (soaps). Preferred silicates include the Sodium Silicate Solutions from PQ Corporation, such as A®1647 Sodium Silicate Solution, a 46.8% active solution of sodium silicate having a $SiO_2/Na_2O$ ratio of about 1.6. Also of use in the compositions of the present invention are the potassium silicates, such as the Kasil® products from PQ Corporation. For example, Kasil®1 Potassium Silicate Solution is of use in the present invention and is a 29.1% solution of potassium silicate having a $SiO_2/K_2O$ ratio of about 2.5. It is preferable to use either sodium or potassium silicate at a level of from about 0.5% to about 5% in the compositions of the present invention.

The compositions of the present invention include a water-soluble polymer such as a polycarboxylate. Particularly suitable polymeric polycarboxylates are derived from acrylic acid, and this polymer and the corresponding neutralized forms include and are commonly referred to as polyacrylic acid, 2-propenoic acid homopolymer or acrylic acid polymer, and sodium polyacrylate, 2-propenoic acid homopolymer sodium salt, acrylic acid polymer sodium salt, poly sodium acrylate, or polyacrylic acid sodium salt. Preferred in the compositions of the present invention is sodium polyacrylate with average molecular weight from about 2,000 to 10,000, more preferably from about 4,000 to 7,000 and most preferably from about 4,000 to 5,000. Soluble polymers of this type are known materials, for example the sodium polyacrylates and polyacrylic acids from Rohm and Haas marketed under the trade name Acusol®. Of particular use in the present invention is the average 4500 molecular weight sodium polyacrylate and the preferred level for use in the composition is from about 0.1% to about 1%.

The compositions of the present invention preferably contain alkali metal carbonate builder at a level of from about 0.1% to about 4%. Most useful in the present invention is sodium carbonate, however potassium carbonate may be used as well. It is well known that sodium carbonate is available in several forms including an anhydrous form as well as three hydrated forms. The hydrated forms include monohydrate, heptahdrate and decahydrates. Any of the commercially available forms of sodium or potassium carbonate find use in the present invention.

Optional ingredients may include other anionic surfactants in addition to alkyl benzene sulfonate and the alkyl ether sulfates mentioned above, particularly for example alkyl sulfates. Additionally, other nonionic surfactants such as the amphoteric surfactants and alkylpolyglycoside surfactants may find use in the compositions of the present invention. Optional too are other builder components besides the silicates and carbonates mentioned previously, lending an additional source of alkalinity or hard water chelation such as borates, tetrasodium ethylenediamine tetraacetate-EDTA, phosphates, zeolite, NTA and the like, bleaching agents (oxygen or chlorine based), optical brighteners, dye fixatives, enzymes, binders, carrier materials and auxiliary ingredients, and minor amounts of perfumes, dyes, solvents, etc. (e.g. cationic surfactants, softening or anti-static agent, water, thickeners, emulsifiers, acids, bases, salt, polymer, bleach catalysts, peroxygen compounds, inorganic or organic absorbents, clays, surface modifier polymer, pH-control agents, other chelants, active salts, abrasives, preservatives, colorants, anti-redeposition agents, opacifiers, anti-foaming agents, cyclodextrines, rheology-control agents, vitamins, oils, nano-particles, visible plastic particles, visible beads, etc.).

With the necessary and optional ingredients thus described, exemplary embodiments of the liquid laundry detergent compositions of the present invention, with and without silicate, with each of the components set forth in weight percent, are shown as Formulations 1-5 in Table 1:

TABLE 1

| Ingredients | Weight Percent (actives %) | | | | |
|---|---|---|---|---|---|
| | 1 | 2 | 3 | 4 | 5 |
| Sodium dodecyl benzene sulfonate | 1.25 | 1.25 | 2.00 | 1.25 | 1.25 |
| Sodium alkyl $C_{14}$-$C_{15}$/7EO ether sulfate | 3.00 | 3.00 | 8.00 | 3.00 | 3.00 |
| Linear alcohol ethoxylate $C_{14}$-$C_{15}$/7EO | 1.80 | 2.20 | 3.00 | 1.80 | 1.80 |
| $C_{14}$-$C_{18}$ Fatty Acid soaps (sodium salts) | 0.15 | 0.15 | 0.45 | 0.15 | 0.15 |
| Sodium Silicate $SiO_2/Na_2O$ ratio = 1.6 | 2.00 | 0 | 3.00 | 0 | 0 |
| Sodium Carbonate | 2.70 | 3.50 | 0.50 | 2.70 | 0 |
| Sodium polyacrylate 4,500 MW | 0.20 | 0.20 | 0.25 | 0.20 | 0 |
| Dyes and fragrances | 0.30 | 0.30 | 0.60 | 0.30 | 0.30 |
| Water | q.s | q.s. | q.s. | q.s. | q.s. |

To demonstrate the effectiveness of the fatty acid in controlling the suds level of the compositions of the present invention, a foam height measurement was conducted for some of these formulations. The test method used was simply a visual evaluation of the foam height on the clear window of an HE washing machine. The window of the machine was marked off in 5 even spaces, with 5 representing the very top of the window. Foam heights are expressed as foam to these levels marked on the window, thus lower values are preferred and represent suds suppression. The results are shown in Table 2 demonstrate that formulas I-3 are very low sudsings.

TABLE 2

| Test | Foam Height | | |
|---|---|---|---|
| | Formulation 1 | Formulation 2 | Formulation 3 |
| Initial | 0 | 0 | 0 |
| 35 mm | 1 | 1 | 1 |
| 30 mm | 0.5 | 0.5 | 0.5 |

TABLE 2-continued

| Test | Foam Height | | |
|---|---|---|---|
| | Formulation 1 | Formulation 2 | Formulation 3 |
| 25 mm | 0 | 0 | 0 |
| 20 mm | 0 | 0 | 0.5 |
| 12 mm | 0 | 0 | 0 |

To demonstrate the whiteness retention when washing with the compositions of the present invention, the following wash conditions were used. Fabric swatches (3 in×3 in) were laundered four times repeatedly in the presence of large amounts of soil, namely 2.6 mL of synthetic sebum soils and 11 mL of clay soils in a 1-liter bath of wash liquor. This repeated soil-laden washing correlates to about 25-30 regular wash cycles for a normal white garment of similar fiber construction. Whiteness of the swatches is then measured spectrophotometrically versus an unwashed white swatch control and is represent as a percent (%) of the original. Differences of 0.5 or greater are visually significant. The results are shown in Table 3 for two types of fabric.

TABLE 3

| Fabric Swatches | Whiteness Maintenance | | |
|---|---|---|---|
| | Formulation 1 | Formulation 4 | Formulation 5 |
| Cotton | 98.24 | 97.91 | 94.67 |
| Polyester/cotton blend | 97.98 | 95.91 | 89.49 |

The table above shows the increase in whiteness maintenance for a formulation incorporating the silicate. It is believed that the silicate mitigates the deleterious effects of the added fatty acid soaps. Most striking is the difference in performance on polyester/cotton between Formulas I and 4, wherein the only difference between the two compositions is the presence of the silicate.

We claim:

1. A liquid laundry detergent composition comprising:

a. from about 0.05% to about 2% by weight of said composition of a fatty acid soap;

b. from about 0.5% to about 4% by weight of linear alkyl benzene sulfonate surfactant;

c. from about 1% to about 10% by weight of an alkyl ether sulfate surfactant;

d. from about 0.5% to about 5% by weight of a linear alcohol ethoxylate nonionic surfactant;

e. from about 0.5% to about 5% of an alkali metal silicate;

f. from about 0.1% to about 1% of sodium polyacrylate homopolymer having molecular weight from about 2,000 to about 10,000; and g. the balance water.

2. The composition of claim 1 wherein the said fatty acid soap is selected from the group consisting of sodium salts of saturated $C_{14}$-$C_{18}$ carboxylic acids, sodium salts of unsaturated $C_{14}$-$C_{18}$ carboxylic acids, potassium salts of saturated $C_{14}$-$C_{18}$ carboxylic acids, potassium salts of unsaturated $C_{14}$-$C_{18}$ carboxylic acids, and mixtures thereof.

3. The composition of claim 1 wherein the said linear alkyl benzene sulfonate surfactant is sodium dodecylbenzene sulfonate.

4. The composition of claim 1 wherein the said alkyl ether sulfate further comprises sodium alkyl ether sulfate with alkyl group carbon chain length of from about 12 to about 18 and a degree of ethoxylation of from about 1.5 to about 9 ethylene oxide moieties.

5. The composition of claim 1 wherein said silicate is sodium silicate having a $SiO_2/Na_2O$ weight ratio of from about 1.6 to about 4.

6. The composition of claim 1 wherein said silicate is potassium silicate having a $SiO_2/K_2O$ weight ratio of from about 1.6 to about 4.

7. The composition of claim 1 wherein said sodium polyacrylate homopolymer has an average molecular weight of from about 4,000 to about 5,000.

8. The composition of claim 1 wherein said linear alkyl ethoxylate nonionic surfactant has carbon chain length of from about 12 to about 18 and a degree of ethoxylation of from about 4 to about 9 ethylene oxide moieties.

9. The composition of claim 1 wherein said composition further comprises from about 0.1% to about 4% of an alkali metal carbonate selected from the group consisting of anhydrous potassium carbonate, hydrated potassium carbonate, anhydrous sodium carbonate, hydrated sodium carbonate and mixtures thereof.

* * * * *